US008950503B2

(12) United States Patent
Purkis

(10) Patent No.: US 8,950,503 B2
(45) Date of Patent: Feb. 10, 2015

(54) CONTROL SYSTEM

(75) Inventor: Daniel Purkis, Aberdeen (GB)

(73) Assignee: Petrowell Limited, Dyce, Aberdeen (GB)

( * ) Notice: Subject to any disclaimer, the term of this patent is extended or adjusted under 35 U.S.C. 154(b) by 490 days.

(21) Appl. No.: 13/122,186

(22) PCT Filed: Oct. 1, 2009

(86) PCT No.: PCT/GB2009/051286

§ 371 (c)(1),
(2), (4) Date: Apr. 28, 2011

(87) PCT Pub. No.: WO2010/038072

PCT Pub. Date: Apr. 8, 2010

(65) Prior Publication Data

US 2011/0290504 A1 Dec. 1, 2011

(30) Foreign Application Priority Data

Oct. 2, 2008 (GB) ..... 0818010.1

(51) Int. Cl.
*E21B 34/10* (2006.01)
*E21B 41/00* (2006.01)

(52) U.S. Cl.
CPC ..... *E21B 41/0085* (2013.01)
USPC ..... 166/375; 166/65.1; 175/106; 290/54

(58) Field of Classification Search
USPC ..... 166/65.1, 319, 375, 374; 175/106; 290/54, 1 R, 1 C
See application file for complete search history.

(56) References Cited

U.S. PATENT DOCUMENTS

| | | | | |
|---|---|---|---|---|
| 3,970,877 | A * | 7/1976 | Russell et al. | 310/339 |
| 4,491,738 | A * | 1/1985 | Kamp | 290/43 |
| 4,515,225 | A * | 5/1985 | Dailey | 175/40 |
| 4,532,614 | A * | 7/1985 | Peppers | 367/81 |
| 4,945,995 | A * | 8/1990 | Tholance et al. | 166/375 |
| 5,149,984 | A * | 9/1992 | Schultz et al. | 290/54 |
| 5,238,070 | A * | 8/1993 | Schultz et al. | 166/386 |
| 5,839,508 | A * | 11/1998 | Tubel et al. | 166/65.1 |
| 5,965,964 | A * | 10/1999 | Skinner et al. | 310/15 |
| 6,679,332 | B2 * | 1/2004 | Vinegar et al. | 166/373 |
| 6,717,283 | B2 * | 4/2004 | Skinner et al. | 290/43 |
| 7,002,261 | B2 | 2/2006 | Cousins | |

(Continued)

FOREIGN PATENT DOCUMENTS

GB 2435310 8/2007

OTHER PUBLICATIONS

International Search Report and Written Opinion, PCT/GB2009/051286, dated Dec. 21, 2009.

*Primary Examiner* — Jennifer H Gay
(74) *Attorney, Agent, or Firm* — Wong, Cabello, Lutsch, Rutherford & Brucculeri LLP

(57) ABSTRACT

A control system for use in a subterranean well comprises at least one power generation device positioned within the subterranean well, the at least one power generation device adapted to supply electrical power to at least one apparatus positioned within the subterranean well and at least one control line positioned in the subterranean well. The at least one control line connects each power generation device to surface and is adapted to supply a hydraulic pressure applied from surface to the at least one power generation device from which the at least one power generation device generates the electrical power to be supplied to the at least one apparatus.

26 Claims, 6 Drawing Sheets

(56) References Cited

U.S. PATENT DOCUMENTS

| | | | | |
|---|---|---|---|---|
| 7,165,608 | B2 * | 1/2007 | Schultz et al. | 166/66.5 |
| 7,190,084 | B2 * | 3/2007 | Hall et al. | 290/1 R |
| 7,201,239 | B1 * | 4/2007 | Perry | 175/104 |
| 7,242,103 | B2 * | 7/2007 | Tips | 290/1 R |
| 7,635,029 | B2 * | 12/2009 | MacDougall et al. | 166/363 |
| 7,699,102 | B2 * | 4/2010 | Storm et al. | 166/244.1 |
| 7,823,636 | B2 * | 11/2010 | Lucas | 166/119 |
| 8,009,059 | B2 * | 8/2011 | Huang et al. | 340/853.3 |
| 8,033,328 | B2 * | 10/2011 | Hall et al. | 166/65.1 |
| 8,322,446 | B2 * | 12/2012 | Smithson et al. | 166/373 |
| 8,322,447 | B2 * | 12/2012 | Loretz et al. | 166/374 |
| 8,453,723 | B2 * | 6/2013 | Smithson | 166/65.1 |
| 2003/0116969 | A1 | 6/2003 | Skinner et al. | |
| 2004/0035591 | A1 * | 2/2004 | Echols | 166/386 |
| 2005/0200210 | A1 * | 9/2005 | Kotsonis et al. | 310/15 |
| 2007/0068680 | A1 * | 3/2007 | Vick, Jr. | 166/386 |
| 2007/0194947 | A1 * | 8/2007 | Huang et al. | 340/854.3 |
| 2007/0194948 | A1 | 8/2007 | Hall et al. | |
| 2007/0261861 | A1 * | 11/2007 | MacDougall et al. | 166/381 |
| 2008/0128123 | A1 | 6/2008 | Gold | |
| 2009/0065192 | A1 * | 3/2009 | Lucas | 166/119 |
| 2010/0059233 | A1 * | 3/2010 | Smithson et al. | 166/385 |
| 2010/0236790 | A1 * | 9/2010 | Smithson | 166/373 |
| 2011/0155393 | A1 * | 6/2011 | Loretz et al. | 166/374 |
| 2011/0290504 | A1 * | 12/2011 | Purkis | 166/373 |

* cited by examiner

CONTROL SYSTEM

FIELD OF THE INVENTION

The present invention relates to an improved control system in a subterranean well. Particularly, but not exclusively the present invention relates to improved control system for controlling a plurality of tools, equipment and apparatus which are positioned in a subterranean well.

BACKGROUND TO THE INVENTION

Directional drilling has made the extraction of hydrocarbons from small reservoirs economically viable because the borehole can be directed in three dimensions through a number of pockets of hydrocarbons.

The hydrocarbons contained in each of these reservoirs flows through a production tube to the surface. Balanced fluid or optimised flow regimes are designed to intend to get the flow from the reservoirs to the surface as quickly as possible and maximise the amount of hydrocarbons extracted from each reservoir. These flow regimes may dictate that the different reservoirs be emptied at different times. The flow of hydrocarbons from a reservoir into the production tube is controlled using downhole tools such as valves. Downhole valves are, generally speaking, hydraulically controlled.

Hydraulic systems are used to control the operation of tools positioned in the well and can comprise surface equipment such as a hydraulic tank, pump etc and control lines for connecting the surface equipment to the downhole tools. The control lines can be connected to one or more downhole tools.

Several basic arrangements of hydraulic control lines are used in a well. In a direct hydraulic arrangement, each tool that is to be controlled will have two dedicated hydraulic lines. The "open" line extends from the surface equipment to the tool and is used for transporting hydraulic fluid to the downhole control valve to operated the tool, while the "close" line extends from the tool to the surface equipment and provides a path for returning hydraulic fluid to the surface. The practical limit to the number of tools that can be controlled using the direct hydraulic arrangement is three, that is six separate hydraulic lines, due to the physical restraints in positioning hydraulic lines in a well. The tubing hanger through which the hydraulic lines run also has to accommodate lines for a gauge system, at least one safety valve and often a chemical injection line, which limits the number of hydraulic lines the hanger can accommodate.

When it is desirable to control more than three tools in a well, a common close arrangement can be employed in which an open line is run to each tool to be controlled and a common close line is connected to each tool to return hydraulic fluid to the surface. The common close system has a practical limit of controlling five tools through the six separate hydraulic lines.

In another arrangement, a single hydraulic line is dedicated to each tool and is connected to each tool via a separate, dedicated controller for each tool. To open the tool, the hydraulic fluid in the dedicated line is pressurised to a first level. Thereafter, the hydraulic fluid in the dedicated line is pressurised to a higher level so as to close the tool.

In a digital hydraulics system, two hydraulic lines are run from the surface equipment to a downhole controller that is connected to each of the tools to be controlled. Each controller is programmed to operate upon receiving a distinct sequence of pressure pulses received through these two hydraulic lines. Each tool has another hydraulic line is connected thereto as a common return for hydraulic fluid to the surface. The controllers employed in the single line and the digital hydraulics arrangements are complex devices incorporating numerous elastomeric seals and springs, which are subject to failure. In addition, these controllers used small, inline filters to remove particles from the hydraulic fluid that might otherwise contaminate the controllers. These filters are prone to clogging and collapsing. Further, the complex nature of the pressure sequences requires a computer operated pump and valve manifold, which is expensive.

An alternative, simpler arrangement which can be used to operate a large number of tools has been proposed utilising RFID tags to activate downhole tools. The RFID tags are programmed with a message for a specific downhole tool. The tag is sent down a control line which runs adjacent the tools. The control line includes a tag reader for each downhole tool, each reader reading the message on the tag as it passes. When the reader associated with the tool the message is intended for reads the tag, the message is relayed to the tool control and the instruction is carried out. The instruction may be to open a valve to allow hydrocarbons to flow into the production tube. Such a system requires a common open line running to all tools, a common close line running to all tools and a tag line down which the RFID tags can be flowed down.

The drawback of such a system is the requirement for power to be continuously supplied to the readers to detect the presence of a tag and then to provide power to the control system to actuate the specific tool. The power is generally provided by batteries. As these batteries are continually supplying power the downhole readers, they can be drained over a period of 2 to 3 weeks and require replacement which can be an extremely expensive and time consuming process.

SUMMARY OF THE INVENTION

According to a first aspect of the present invention there is provided an improved control system for use in a subterranean well, the system comprising:

at least one apparatus positioned within the subterranean well;

at least one power generation device positioned within the subterranean well, the at least one power generation device adapted to supply electrical power to the at least one apparatus; and at least one control line positioned in the subterranean well, the at least one control line adapted to supply a hydraulic pressure applied from surface to the at least one power generation device from which the at least one power generation device generates electrical power.

In one embodiment, the present invention provides a control system for use in a subterranean well which includes a power generation device, which generates electrical power in response to the application of hydraulic pressure from surface. As electrical power can be generated by the power generation device as and when required, the downhole life of such a system is extended.

The/each power generation device may be adapted to supply electrical power to more than one downhole apparatus. In one embodiment a power generation device may power an RFID tag reader and a downhole tool such as a valve.

The/each power generation device may be adapted to supply electrical power to an energy storage device such as a battery, a capacitor, a spring, a compressed fluid device such as a gas spring or the like.

In an alternative embodiment, the/each power generation device may be adapted to supply electrical power to a drive means to raise a weight against gravity. Energy would be stored in such a device, which can be harnessed by allowing the weight to fall under the influence of gravity.

In one embodiment, the power generation device converts the applied hydraulic pressure in to linear motion.

Preferably, the power generation device comprises a piston to convert the applied hydraulic pressure in to linear motion.

In one embodiment, the power generation device is further adapted to convert the linear motion into rotary motion. The power generation device may include a ball screw or rack and pinion for this purpose.

In an alternative embodiment, the power generation device is adapted to convert the applied hydraulic pressure in to rotary motion.

Preferably, the power generation device is adapted to convert rotary motion to electrical power. The power generation device may include a generator for this purpose. The generator may be a dynamo. A dynamo can generate AC or DC power.

In one embodiment, in which the power generation device produces AC power, the control system further comprises a rectifier or switch mode regulator. A rectifier or switch mode regulator converts an AC input into a DC output.

The power generation device may include a biasing means adapted to resist the application of hydraulic pressure.

In one embodiment in which the power generation device converts the applied hydraulic pressure in to linear motion using a piston, the piston is moveable between a first position and a second position and comprises a biasing means to bias the piston to the first position. In this embodiment, the hydraulic pressure moves the piston against the biasing means to the second position, generating linear motion. Once the applied hydraulic pressure is removed the biasing means returns the piston to the first position generating further linear motion which is, in turn, converted into electrical power.

The biasing means may comprise a compression spring, a wind up spring, a coil spring, a leaf spring, a gas spring, well pressure, a suspended weight or the like.

Alternatively, downhole pressure could be utilised to provide the biasing means or to return the piston to the first position.

In a further alternative, a second control line may be provided in the well to provide the biasing means or to return the piston to the first position.

According to a second aspect of the present invention there is provided a method of controlling at least one apparatus positioned within a subterranean well, the method comprising the steps of:

applying a hydraulic pressure from surface to a power generation device, the power generation device adapted to convert the applied force into electrical energy, the electrical energy being used to control at least one apparatus positioned within the subterranean well.

BRIEF DESCRIPTION OF THE DRAWINGS

Embodiments of the present invention will now be described with reference to the accompanying drawings in which.

DETAILED DESCRIPTION OF THE INVENTION

Figure 1:
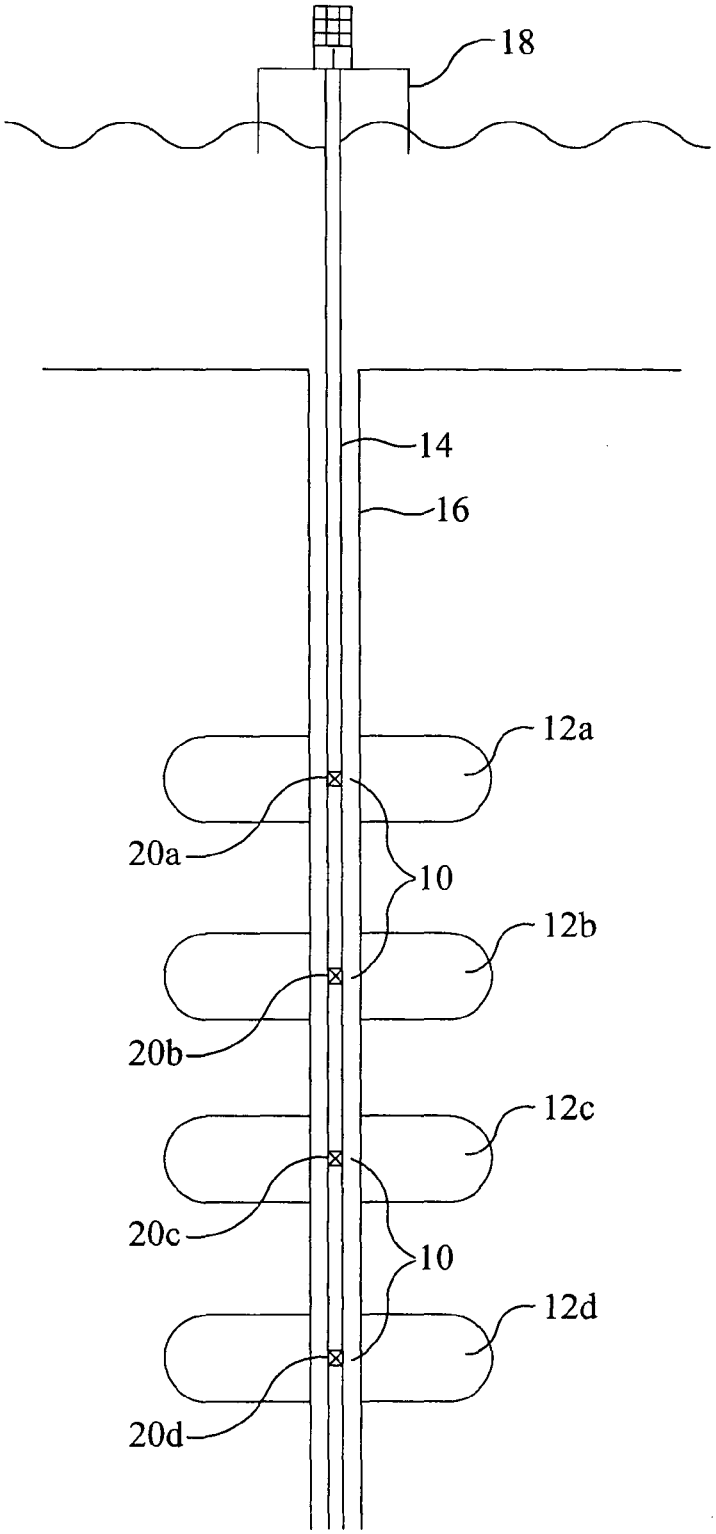
FIG. 1 is a section view through a subterranean well showing a control system according to a first embodiment of the present invention.

Reference is made to FIG. 1, a schematic of a control system, generally indicated by reference numeral 10, according to a first embodiment of the invention.

The control system 10 controls the flow of hydrocarbons from each of four hydrocarbon reservoirs 12*a-d* into a production tube 14 which is disposed within a subterranean well 16, the production tube 14 extending from the reservoirs 12*a-d* up to an oil rig 18. Specifically, the control system 10 controls four downhole tools 20*a-d* which permit the hydrocarbons from reservoirs 12*a-d* respectively to flow into the production tube 14.

Figure 2:
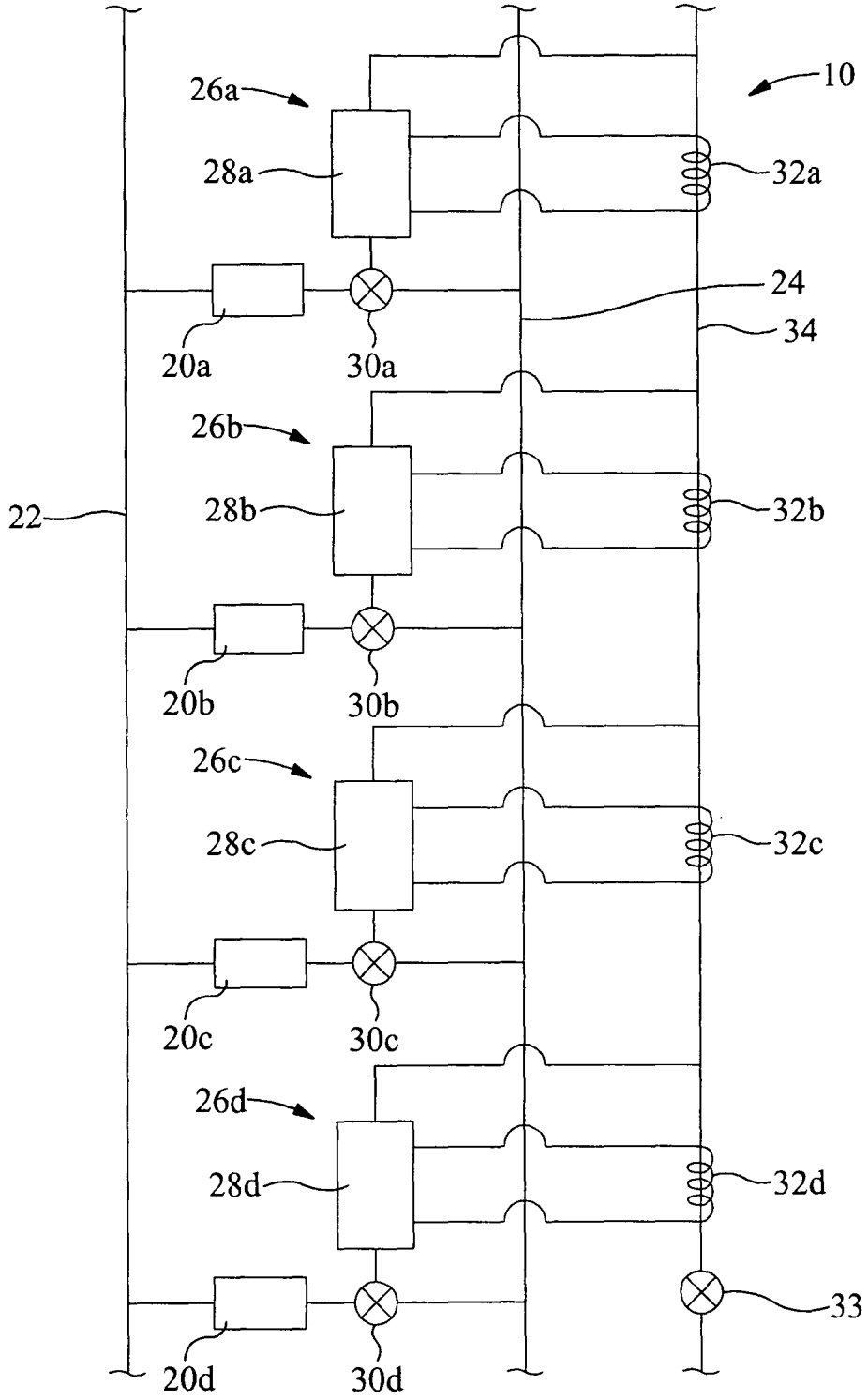
FIG. 2 is a schematic of the control system of FIG. 1.

Referring now to FIG. 2, a schematic of the control system 10 of FIG. 1 is shown. The control system 10 controls each of the four downhole tools by selectively allowing each tool 20*a-d* to be exposed to hydraulic pressure applied through a first hydraulic line 22 and/or a second hydraulic line 24.

The control system 10 comprises four control system units 26*a-d*. Each control system unit 26*a-d* comprises a corresponding power generation device 28*a-d*, each power generation device 28*a-d* adapted to supply electrical power to two apparatus; a corresponding needle valve 30*a-d* and a corresponding RFID tag reader 32*a-d*.

The control system 10 further comprises a control line 34 which supplies hydraulic pressure from the rig 18 to each of the power generation devices 28*a-d*. The third control line 34 includes a valve 33 which can be closed from surface to allow for hydraulic pressure to be built up in the third control line 34. As will be discussed, each power generation device 28*a-d* is adapted to generate power from the applied hydraulic pressure, the generated power being used to operate the corresponding needle valve 30*a-d* and/or the corresponding RFID tag reader 32*a-d*.

Figure 3:
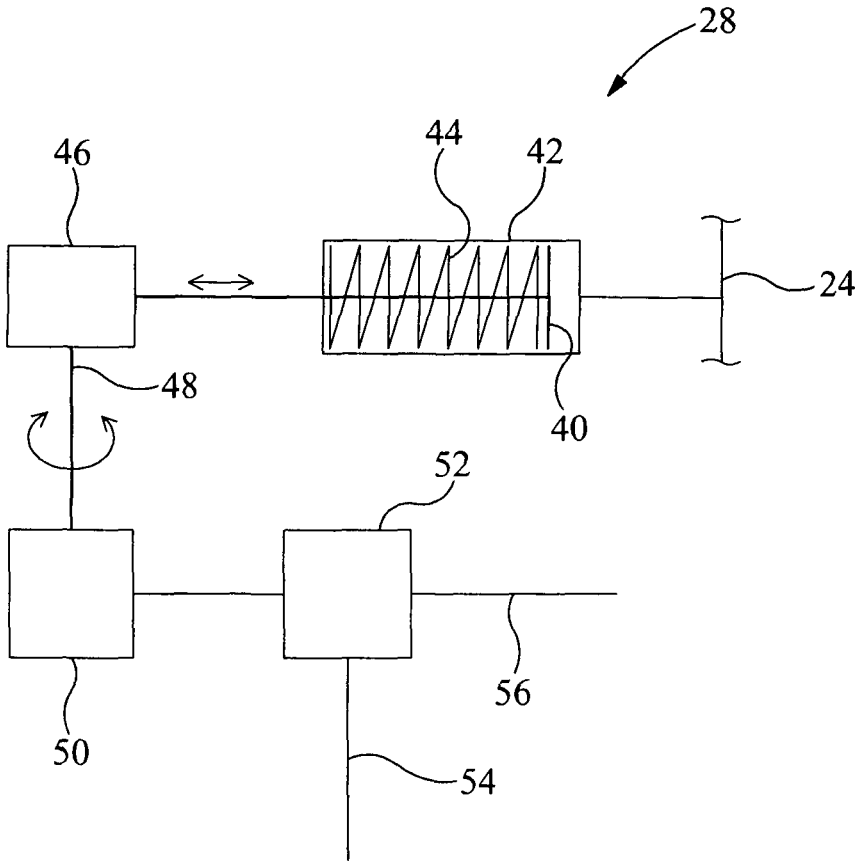
FIG. 3 is a schematic of the power generation device of the system of FIG. 1.

The power generation device 28 shown in FIG. 3 may represent any one of the power generation devices 28*a-d*. The power generation device 28 comprises a piston 40 in a housing 42. The piston 40 is shown in FIG. 3 located in a first position to which it is biased by a compression spring 44.

The piston 40 is connected to a ball screw device 46 for converting linear motion of the piston 40 into rotary motion. The rotary motion is transferred by a transfer rod 48 to a generator 50. The generator 50 is connected to a rectifier 52 which produces a direct current, which is supplied to the needle valve (not shown) by a first wire 54 and to the RFID tag reader (not shown) by a second wire 56.

To operate the power generation device 28, the third control line valve 33 is closed and hydraulic pressure is applied through the third control line 34, to the piston 40. The application of pressure moves the piston 40 towards the ballscrew 46, against the bias of the compression spring 44 generating electrical power through the generator 50 and rectifier 52 for supply to the needle valve (not shown) and RFID tag reader (not shown).

Once the piston 40 has reached the extent of its travel the hydraulic pressure in the third control line 34 is released by opening the third control line valve 33, allowing the piston 40 to travel back to the first position. During this return travel more electrical power is generated which the rectifier 52 converts to direct current for supply to the needle valve (not shown) and the RFID tag reader (not shown).

Referring back to FIG. 2, the operation of the control system 10 will now be described. The objective of the control system 10 is to allow one of the tools 20*a-d* to be operated by exposure to hydraulic pressure through one of the first or second control lines 22, 24.

In this example, an RFID tag (not shown) is to be sent from the rig 18 with an instruction to operate the third tool 20*c*. The third tool 20*c* is to be operated by opening the third needle valve 30*c* permitting a hydraulic pressure applied by the first control line 22 to be released by activating the tool 20*c*.

The first step of this operation is to apply a hydraulic pressure to the third control line 34 to generate power, through the power generation devices 28*a-d* to, initially, operate the RFID tag readers 32*a-d*, and apply a hydraulic pressure through the first hydraulic line 22 to operate the tool 20*c*. The tool 20*c* is prevented from operating by the needle valve 30*c* which is closed and is containing the pressure.

Once the pistons 40 have reached the extent of their travel the pressure in the third control line 34 is reduced by opening the third control line valve 33, permitting the pistons 40 to return to their start positions and generate further power. Once the readers 32*a-d* are operational and the third control line valve 33 is open, RFID tags containing the message to operate the third tool 20*c* are sent down the third control line 34.

The tag flows down the third control line 34 passing through the four tag readers 32*a-d*. The first, second and fourth readers 32*a,b,d* will ignore the message on the tag but the third reader 32*c* will transfer the message to the needle valve 30*c*. Using power generated by the third power generation device 28*c*, the needle valve 30*c* opens, releasing the hydraulic pressure in the first hydraulic line 22 permitting the tool 20*c* to operate.

Figure 4:
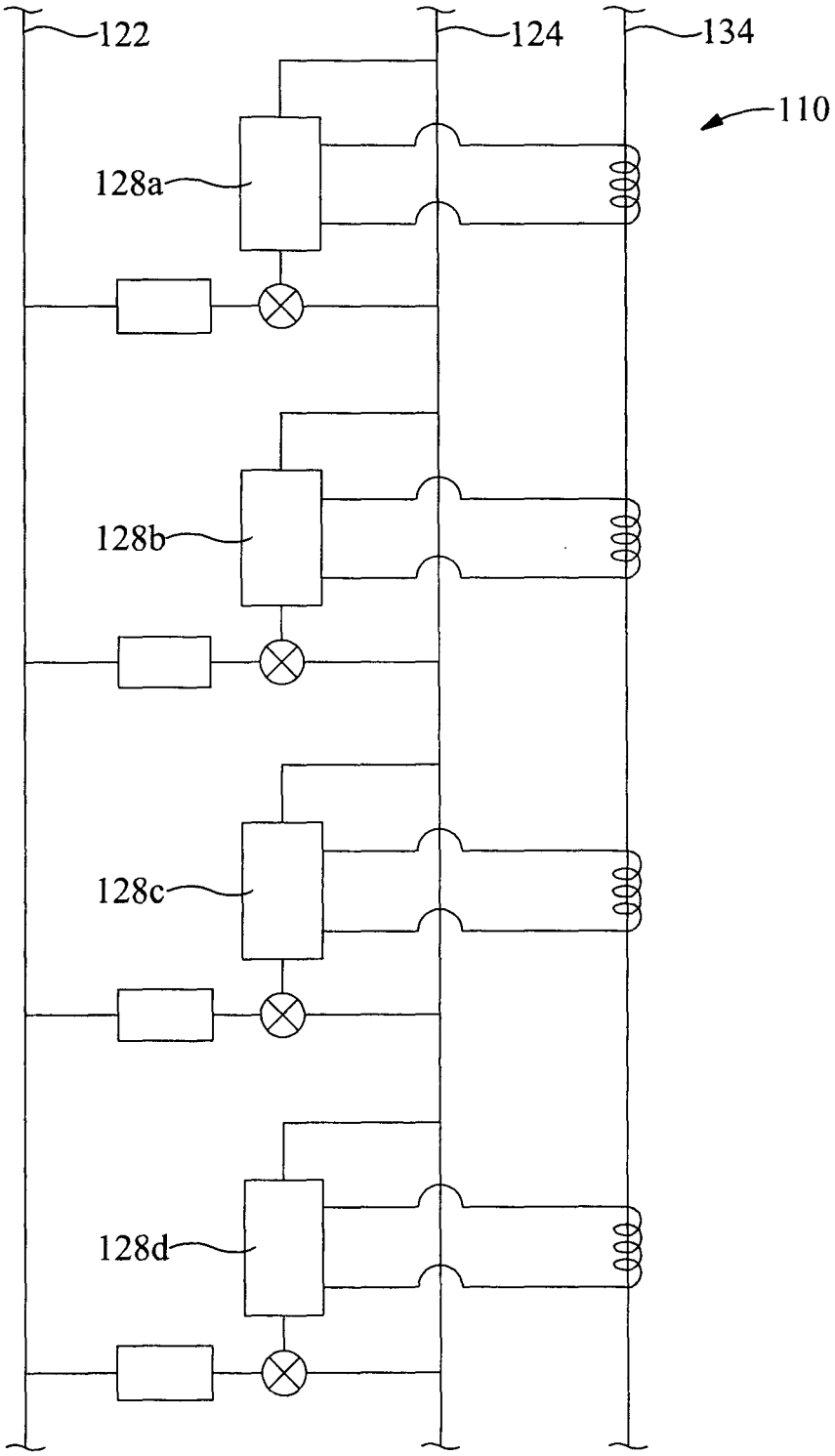
FIG. 4 is a schematic of a control system according to a second embodiment of the present invention.

Reference is now made to FIG. 4, a schematic of a control system 110 according to a second embodiment of the present invention. This system 110 includes first and second control lines 122, 124 and is largely similar to the system 10 of the first embodiment, the difference being that each power generation device 128*a-d* is operated by the application of hydraulic pressure through the second control line 124. The operation of the system 110 is otherwise the same.

Figure 5:
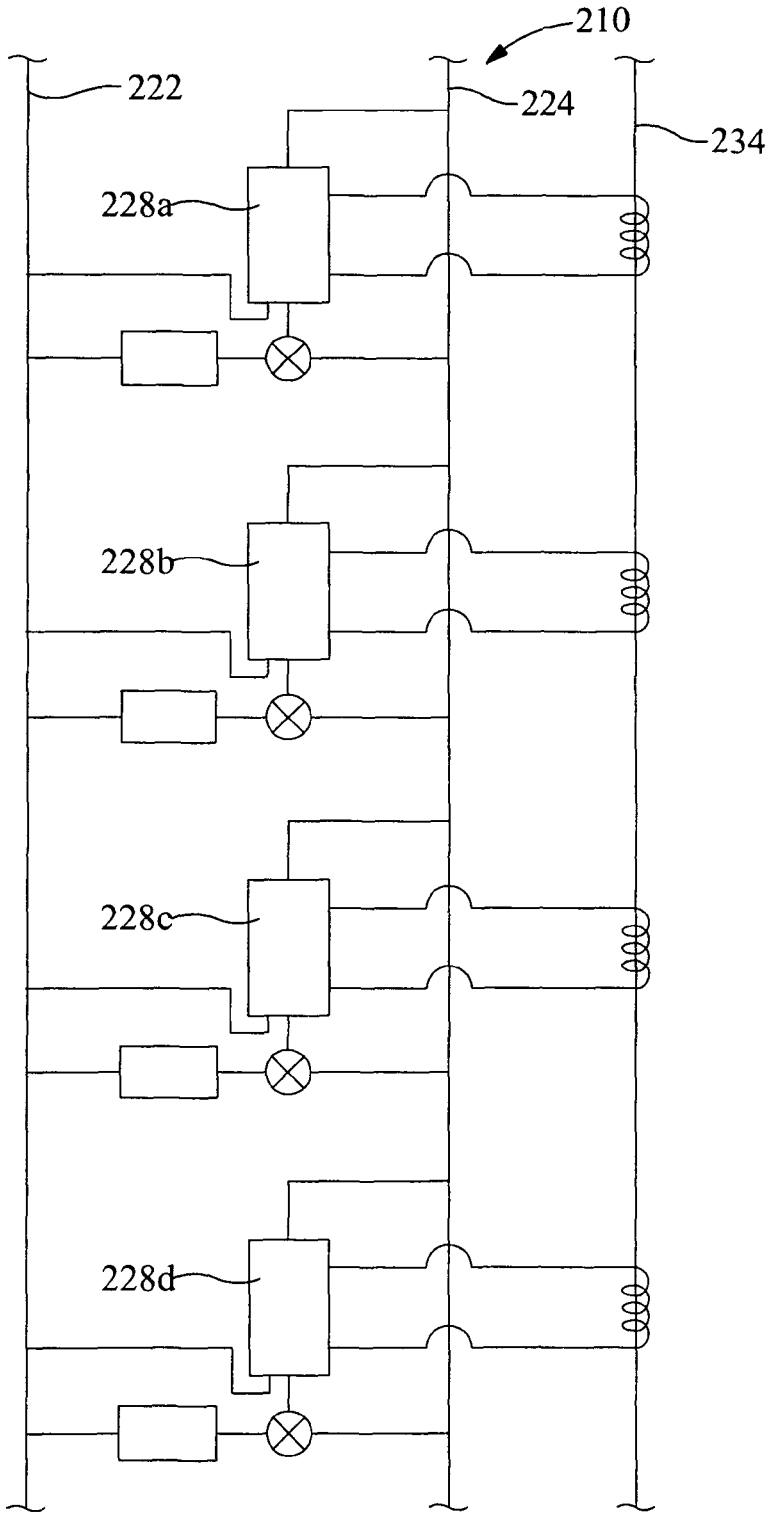
FIG. 5 is a schematic of a control system according to a third embodiment of the present invention.
Figure 6:
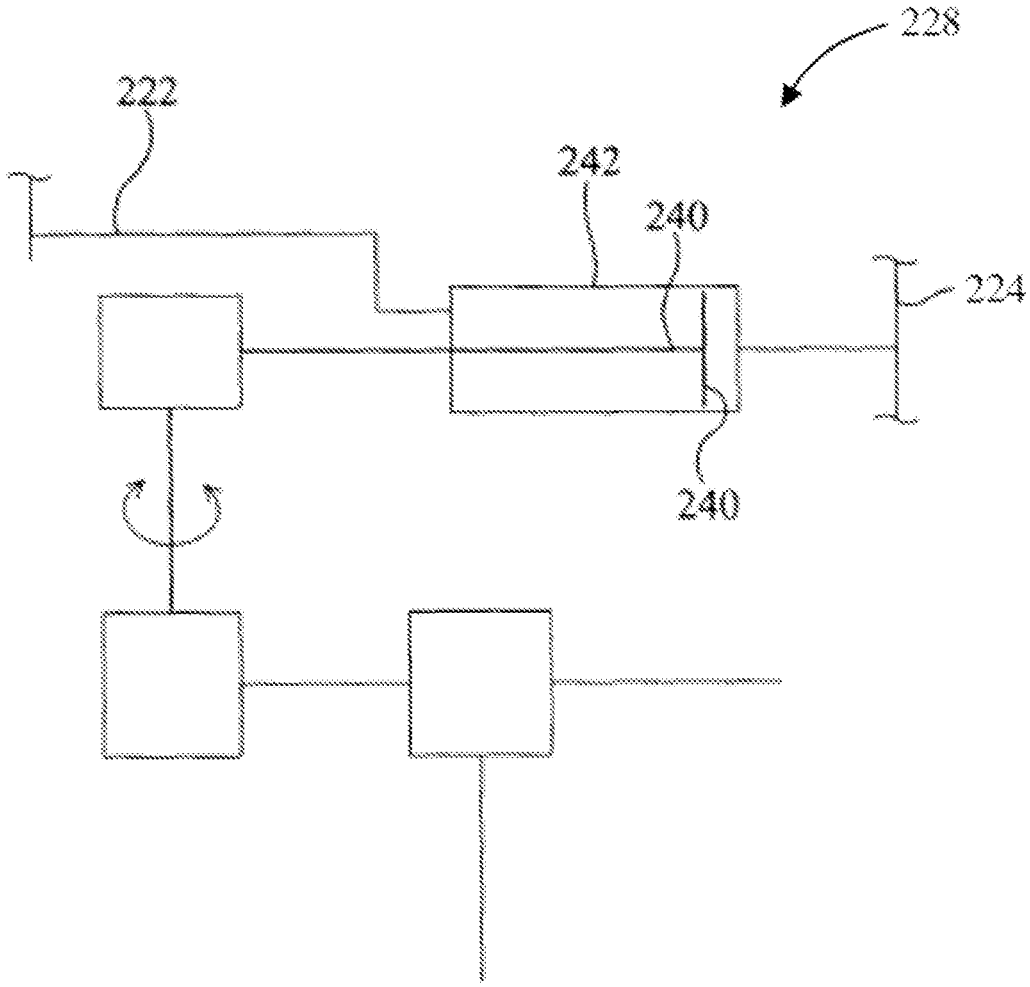
FIG. 6 is a schematic of the power generation device of the system of FIG. 5.

Reference is now made to FIG. 5, a schematic of a control system 210 according to a third embodiment of the present invention. This system is largely similar to the system 110 of the second embodiment, the difference being that the power generation devices 228*a-d* are connected to both the first and second control lines 222, 224. to the power generation device 228 shown in FIG. 6 may represent any one of the power generation devices 228*a-d*. From FIG. 6, it can be seen that the first and second control lines 222, 224 are fed to either side of the piston 240. As can be seen from FIG. 6, there is no biasing spring in the housing 242, the piston 240 being moved to the left by application of hydraulic pressure through second line 224, and returned to the start position by the application of pressure through the first hydraulic line 222.

Various modifications and improvements may be made to the above described embodiments without departing from the scope of the invention. For example, each power generation device may supply power to a battery or other energy storage device for storage until required.

The invention claimed is:

1. A control system for use in a subterranean well, the system comprising:

a control line within the subterranean well;

a hydraulic line within the subterranean well;

a power generation device positioned within the subterranean well, the power generation device being configured to receive hydraulic pressure applied from surface via at least one of the control line and the hydraulic line and to generate electrical power from the applied hydraulic pressure; and an electrically activated valve positioned within the subterranean well, wherein the electrically activated valve is adapted to receive electrical power generated by the power generation device thereby enabling the valve to selectively allow hydraulic pressure to be applied via the hydraulic line to a hydraulically activated downhole tool positioned within the subterranean well for the selective operation of the downhole tool.

2. The control system of claim 1, wherein the power generation device is adapted to supply electrical power for at least one downhole device in addition to the electrically activated valve.

3. The control system of claim 2, wherein the power generation device provides power for an RFID tag reader.

4. The control system of claim 1, wherein the power generation device is adapted to supply electrical power to an energy storage device which includes at least one of a battery, a capacitor, a spring, a compressed fluid device and a gas spring.

5. The control system of claim 1, wherein the power generation device is adapted to supply electrical power to a drive means to raise a weight against gravity.

6. The control system of claim 1, wherein the power generation device converts the applied hydraulic pressure into linear motion.

7. The control system of claim 6, wherein the power generation device comprises a piston to convert the applied hydraulic pressure into linear motion.

8. The control system of claim 7, wherein the power generation device is further adapted to convert the linear motion into rotary motion.

9. The control system of claim 8, wherein the power generation device includes a ball screw or rack and pinion for converting the linear motion into rotary motion.

10. The control system of claim 7, wherein the power generation device converts the applied hydraulic pressure into linear motion using a piston, the piston is moveable between a first position and a second position and comprises a biasing means to bias the piston to the first position.

11. The control system of claim 10, wherein the hydraulic pressure moves the piston against the biasing means to the second position, generating linear motion.

12. The control system of claim 10, wherein downhole pressure is utilised to provide the biasing means or to return the piston to the first position.

13. The control system of claim 10, wherein pressure is provided from surface to provide the biasing means or to return the piston to the first position.

14. The control system of claim 1, wherein the power generation device is adapted to convert the applied hydraulic pressure into rotary motion.

15. The control system of claim 1, wherein the power generation device is adapted to convert rotary motion to electrical power.

16. The control system of claim 15, wherein the power generation device produces AC power and the control system further comprises a rectifier or switch mode regulator.

17. The control system of claim 1, wherein the power generation device includes a biasing means adapted to resist the application of hydraulic pressure.

18. The control system of claim 17, wherein the biasing means comprises at least one of a compression spring, a wind up spring, a coil spring, a leaf spring, a gas spring, well pressure, and a suspended weight.

19. The control system of claim 1, wherein the electrically activated valve is an electrically activated needle valve.

20. The control system of claim 1, comprising first and second hydraulic lines within the subterranean well, wherein the hydraulic pressure selectively applied to the hydraulically activated downhole tool is provided via the first and/or second hydraulic lines.

21. The control system of claim 20, wherein the hydraulic pressure applied to the power generation device is supplied via the first and/or second hydraulic lines.

22. The control system of claim 1, comprising an RFID tag reader configured to read an RFID tag present in the control line, wherein the electrically activated valve selectively allows hydraulic pressure to be applied to the hydraulically activated downhole tool for the selective operation of the downhole tool according to information which the RFID tag reader reads from the RFID tag.

23. The control system of claim 1, comprising:

a plurality of power generation devices positioned within the subterranean well, each power generation device being configured to receive hydraulic pressure applied from surface via at least one of the control line and the hydraulic line and to generate electrical power from the applied hydraulic pressure; and a plurality of electrically activated valves positioned within the subterranean well, wherein each electrically activated valve is adapted to receive electrical power generated by a corresponding one of the power generation devices thereby enabling each valve to selectively allow hydraulic pressure to be applied via the hydraulic line to at least one corresponding hydraulically activated downhole tool positioned within the subterranean well for the selective operation of the at least one corresponding downhole tool.

24. A method of controlling a downhole tool positioned within a subterranean well, the method comprising the steps of:

applying hydraulic pressure from surface via at least one of a control line and a hydraulic line to a power generation device positioned within the subterranean well, using the power generation device to convert the applied hydraulic pressure into electrical power; and providing the electrical power generated by the power generation device to an electrically activated valve positioned within the subterranean well thereby enabling the valve to selectively allow hydraulic pressure to be applied via the hydraulic line to a hydraulically activated downhole tool positioned within the subterranean well for the selective operation of the downhole tool.

25. A downhole system for use in a subterranean well, the downhole system comprising:

the control system of claim 1; and the hydraulically activated downhole tool.

26. A downhole system for use in a subterranean well, the downhole system comprising:

the control system of claim 23; and the plurality of hydraulically activated downhole tools.

* * * * *